US010066326B2

(12) United States Patent
Ji et al.

(10) Patent No.: US 10,066,326 B2
(45) Date of Patent: Sep. 4, 2018

(54) HIGH-STRENGTH FABRIC AND MANUFACTURING METHOD THEREFOR

(71) Applicant: ZHENGZHOU ZHONGYUAN DEFENSE MATERIAL CO., LTD, Zhengzhou (CN)

(72) Inventors: Changgan Ji, Zhengzhou (CN); Ruiwen Yin, Zhengzhou (CN); Junying Ma, Zhengzhou (CN)

(73) Assignee: Zhengzhou Zhongyuan Defense Material Co., Ltd., Zhengzhou (CN)

( * ) Notice: Subject to any disclaimer, the term of this patent is extended or adjusted under 35 U.S.C. 154(b) by 173 days.

(21) Appl. No.: 14/900,153

(22) PCT Filed: Jun. 20, 2013

(86) PCT No.: PCT/CN2013/077548

§ 371 (c)(1),
(2) Date: Dec. 19, 2015

(87) PCT Pub. No.: WO2014/201654

PCT Pub. Date: Dec. 24, 2014

(65) Prior Publication Data

US 2016/0145777 A1 May 26, 2016

(51) Int. Cl.

| | |
|---|---|
| ***D03D 15/00*** | (2006.01) |
| ***D04B 1/16*** | (2006.01) |
| ***D02G 3/06*** | (2006.01) |

(52) U.S. Cl.

CPC ..... *D03D 15/0088* (2013.01); *D02G 3/06* (2013.01); *D04B 1/16* (2013.01);

(Continued)

(58) Field of Classification Search

CPC ..... D03D 15/0088

(Continued)

(56) References Cited

U.S. PATENT DOCUMENTS

| | | | | |
|---|---|---|---|---|
| 5,578,373 | A | 11/1996 | Kobayashi et al. | |
| 2011/0124835 | A1* | 5/2011 | De Weijer | D01D 5/42 526/352 |
| 2013/0213208 | A1* | 8/2013 | Compton | F41H 5/0478 89/36.02 |

FOREIGN PATENT DOCUMENTS

| | | |
|---|---|---|
| CA | 2 730 214 A1 | 1/2010 |
| CN | 1033848 A | 7/1989 |

(Continued)

OTHER PUBLICATIONS

Canadian Intellectual Property Office; Office Action dated Nov. 18, 2016 issued in corresponding Canadian Patent Application No. 2,914,863, total 3 pages.

(Continued)

*Primary Examiner* — Brent T O'Hern

(74) *Attorney, Agent, or Firm* — Masuvalley & Partners

(57) ABSTRACT

The invention provides a high-strength fabric and a manufacturing method thereof. The manufacturing method includes: connecting at least one group of single yarns according to a certain law to manufacture a fabric body, wherein the high-strength fabric includes at least the fabric body, and each single yarn is manufactured by converging or converging and twisting an ultra-high molecular weight polyethylene thin film or strip. The high-strength fabric has the advantages of good structural integrity, simple manufacturing process, high production efficiency, high strength, high strength utilization ratio, light weight, no pollution and good bulletproof performance.

13 Claims, 5 Drawing Sheets

(52) U.S. Cl.
CPC ..... *D10B 2321/0211* (2013.01); *D10B 2401/063* (2013.01); *D10B 2501/04* (2013.01)

(58) Field of Classification Search
USPC ..... 428/181
See application file for complete search history.

(56) References Cited

FOREIGN PATENT DOCUMENTS

| | | | |
|---|---|---|---|
| CN | 2309353 | Y | 3/1999 |
| CN | 101678603 | A | 3/2010 |
| CN | 101903573 | A | 12/2010 |
| CN | 102149861 | A | 8/2011 |
| EP | 2113376 | A1 | 11/2009 |
| JP | H06-10233 | A | 1/1994 |
| JP | H08-151635 | A | 6/1996 |
| JP | H08-260232 | A | 10/1996 |
| JP | 2001-081648 | A | 3/2001 |
| JP | 2007-182065 | A | 7/2007 |
| KR | 10-2011-0038688 | A | 4/2011 |
| WO | 2008-048301 | A2 | 4/2008 |
| WO | 2010-122099 | A1 | 10/2010 |

OTHER PUBLICATIONS

ISA/CN Authorized officer, Gang Feng, International Search Report dated Mar. 27, 2014 in International Application No. PCT/CN2013/077548, total 8 pages with translation.

EPO, Extended European Search Report dated Mar. 6, 2017 in corresponding European Patent Application No. 13887302.1, 10 pages.

* cited by examiner

HIGH-STRENGTH FABRIC AND MANUFACTURING METHOD THEREFOR

RELATED APPLICATIONS

This application is the U.S. National Phase application under 35 U.S.C. § 371 of International Patent Application No. PCT/CN2013/077548, International Filing Date Jun. 20, 2013, entitled HIGH-STRENGTH FABRIC AND MANUFACTURING METHOD THEREFOR; all of which is incorporated herein by reference in its entirety.

FIELD OF THE INVENTION

The invention relates to the field of application of polymer materials and particularly relates to a high-strength fabric and a manufacturing method therefor.

BACKGROUND OF THE INVENTION

Ultra-high molecular weight polyethylene (Ultra High Molecular Weight Polyethylene, referred to as UHMW-PE) is a thermoplastic engineering plastic with a linear structure and excellent comprehensive performance, and one of important uses of the material is to manufacture a high-strength fiber on the basis of the material. The ultra-high molecular weight polyethylene fiber is a high-performance fiber, has the advantages of high strength, wear resistance, impact resistance, corrosion resistance, UV resistance and the like and can be widely applied in multiple fields, for example, the ultra-high molecular weight polyethylene fiber can be used for preparing ropes, fishing nets, various fabrics and the like in the civil field, can be applied to manufacturing of bulletproof vests, bulletproof helmets and the like in the field of individual protection products, and can also be applied to manufacturing of bulletproof floors, armored protection plates and the like in the field of national defense and military supplies.

As the ultra-high molecular weight polyethylene fiber has a silk-like structure (the fiber number of a single yarn is about 2.5 deniers), in the process of preparing the various fabrics based on the ultra-high molecular weight polyethylene fibers, the multiple fibers with the silk-like structures need to be subject to finishing, interweaving or non-interweaving type connection respectively, the process is complex, and the cost is high. In the manufacturing process of the product, the surfaces of the fibers are liable to production of burrs due to friction, the tension of the various fibers can not be kept uniform and consistent, and the fibers are liable to breaking, distortion, intertwining and other phenomena, thereby being not conductive to realizing integral uniform stress of the multiple fibers, enabling the integral strength of the manufactured product to be often lower than the sum of the strengths of the multiple ultra-high molecular weight polyethylene fibers and causing relatively low strength utilization ratio.

SUMMARY OF THE INVENTION

The brief summary of the invention is given below to facilitate the basic understanding of some aspects of the invention. It should be understood that the summary is not an exhaustive summary of the invention. It is not intended to determine key or important parts of the invention or limit the scope of the invention. It only aims at presenting some concepts in a simplified form as a prelude to the more detailed description which will be discussed later.

The invention provides a high-strength fabric with simple process and low cost and a manufacturing method therefor.

In one aspect, the invention provides a manufacturing method of a high-strength fabric, which comprises at least the following step: connecting at least one group of single yarns according to a certain law to manufacture a fabric body, wherein the high-strength fabric comprises at least the fabric body, and each single yarn is manufactured by converging or converging and twisting an ultra-high molecular weight polyethylene thin film or strip.

Optionally, connecting the at least one group of single yarns according to the certain law to manufacture the fabric body comprises: interweaving the at least one group of single yarns into a whole according to the certain law to obtain the fabric body.

Optionally, interweaving the at least one group of single yarns into a whole according to the certain law comprises: performing two-dimensional interweaving or three-dimensional interweaving on the at least one group of single yarns to form a whole.

Optionally, interweaving comprises: weaving, knitting or plaiting.

Optionally, connecting the at least one group of single yarns according to the certain law to manufacture the fabric body comprises: performing non-interweaving type connection on the at least one group of single yarns according to the certain law to obtain a whole.

Optionally, each group of single yarns comprises multiple single yarns, the fabric body comprises at least one single-layer structure, and the method for preparing the single-layer structure comprises: sequentially performing arrangement and non-interweaving type connection on the multiple single yarns along a direction to form a whole.

Optionally, the non-interweaving type connection comprises: binding connection, bonding or hot-pressing connection.

Optionally, the manufacturing method of the high-strength fabric further comprises: crosswise compounding and laminating the multiple single-layer structures at certain angles to form a whole.

Optionally, the intersection angles of any two adjacent single-layer structures are the same.

Optionally, the intersection angle is 0-90 degrees.

Optionally, the intersection angle is 45 degrees or 90 degrees.

Optionally, the intersection angles of at least two single-layer structures in the various single-layer structures are different from the intersection angles of other single-layer structures.

Optionally, the intersection angles of every two adjacent single-layer structures from the first single-layer structure to the last single-layer structure are gradually increased.

Optionally, the related parameters of the ultra-high molecular weight polyethylene thin film at least meet one or more of the following conditions:

the linear density is above 5000 deniers;
the width is above 100 mm;
the thickness is below 0.2 mm;
the breaking strength is above 10 grams/denier;
the tensile modulus is above 800 grams/denier; and
the elongation at break is below 6%.

Optionally, the related parameters of the ultra-high molecular weight polyethylene strip at least meet one or more of the following conditions:

the linear density is above 100 deniers;
the width is 1-100 mm;
the thickness is below 0.2 mm;

the breaking strength is above 10 grams/denier;

the tensile modulus is above 800 grams/denier; and the elongation at break is below 6%.

In another aspect, the invention further provides a high-strength fabric, and the high-strength fabric is manufactured by adopting the manufacturing method.

The technical scheme provided by the invention is essentially different from the traditional technologies applying ultra-high molecular weight polyethylene and is a revolutionary innovation against the traditional technologies, namely the single yarns manufactured by converging or converging and twisting the ultra-high molecular weight polyethylene thin films or strips are used for replacing traditional ultra-high molecular weight polyethylene fibers to develop and manufacture various high-strength fabrics. That is, the manufacturing process of the high-strength fabric is to perform processing treatment of the fabric body on the basis of the single yarns. Compared with the traditional fabric obtained by processing treatment on the basis of the ultra-high molecular weight polyethylene fibers, when the fabric manufactured according to the invention bears a load, the single yarns are stressed as a whole, and the fabric has one or more advantages of good structural integrity, simple manufacturing process, high production efficiency, high strength, high strength utilization ratio, light weight, no pollution, good bulletproof performance and the like. These and other advantages of the invention will be evident through the following detailed description of optional embodiments of the invention in conjunction with the accompanying drawings.

BRIEF DESCRIPTION OF THE DRAWINGS

The invention can be better understood through the following description in conjunction with the accompanying drawings, wherein the same or similar reference symbols are used in all the drawings to represent the same or similar parts. The accompanying drawings together with the detailed description are included in the description and, form one part of the description, and are used for further illustrating the optional embodiments of the invention and explaining the principle and the advantages of the invention. Wherein.

Those of skilled in the art should understand that elements in the accompanying drawings are only illustrated for simplicity and clarity, and are not necessarily drawn to scale. For example, the sizes of some elements in the accompanying drawings may be exaggerated relative to other elements so as to assist in improvement of the understanding of the embodiments of the invention.

DETAILED DESCRIPTION OF THE EMBODIMENTS

The exemplary embodiments of the invention will be described in detail below in conjunction with the accompanying drawings. For clarity and brevity, not all the characteristics of the actual implementations are described in the description. However, it should be understood that, in the process of developing any of these actual embodiments, many decisions which are specific to the implementations must be made to facilitate the implementation of specific targets of developers, such as compliance with system-related and business-related constraints, which may vary from one implementation to another. In addition, it should also be understood that, although the development work may be very complex and time-consuming, the development work is just a routine task for those skilled in the art and benefiting from the disclosure.

Herein, it still needs to be noted that, in order to prevent the unnecessary details from obscuring the invention, only the device structure and/or the treatment steps which are closely related to the schemes of the invention are described in the accompanying drawings and the description, and the representations and the descriptions of the parts and the treatments which are not closely related to the invention and known to those of ordinary skill in the art are omitted.

Ultra-high molecular weight polyethylene is polyethylene with molecular weight of above 1 million. The traditional technologies applying the ultra-high molecular weight polyethylene take ultra-high molecular weight polyethylene fibers as the basis to manufacture various products. The technical schemes provided by various embodiments of the invention are essentially different from the traditional technologies applying ultra-high molecular weight polyethylene and are revolutionary innovations against the traditional technologies, namely an ultra-high molecular weight polyethylene thin film or strip is used for replacing ultra-high molecular weight fibers to research and manufacture application products, and the core concept mainly comprises: a single yarn manufactured by converging or converging and twisting the ultra-high molecular weight polyethylene thin film or strip is used for replacing traditional ultra-high molecular weight polyethylene fibers to develop and manufacture various fabrics.

Figure 1A:
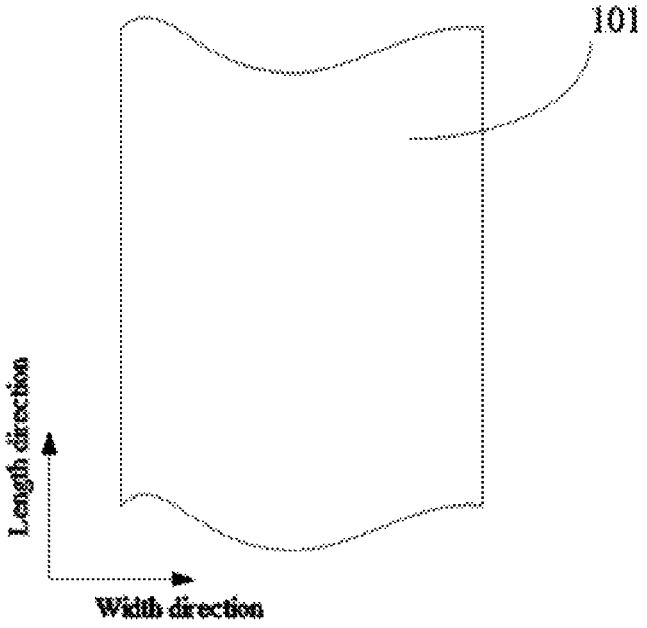
FIG. 1*a* is a schematic diagram of an optional structure of an ultra-high molecular weight polyethylene thin film provided by an embodiment of the invention.
Figure 1B:
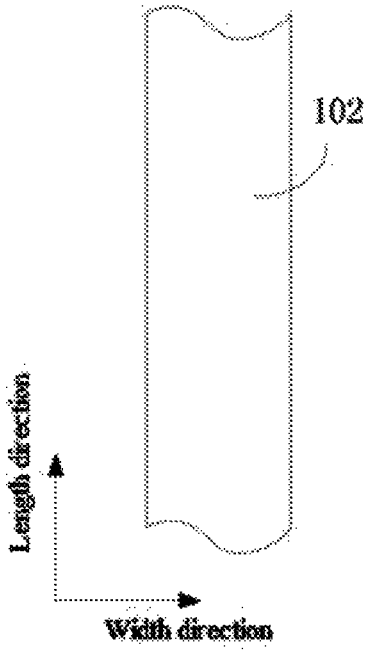
FIG. 1*b* is a schematic diagram of an optional structure of an ultra-high molecular weight polyethylene strip provided by an embodiment of the invention.

Wherein, as shown in FIG. 1*a*, the ultra-high molecular weight polyethylene thin film 101 is a thin slice which is manufactured from ultra-high molecular weight polyethylene and has a certain width and thickness, wherein the width is much greater than the thickness. As shown in FIG. 1*b*, the ultra-high molecular weight polyethylene strip 102 is a strip-like thin slice which can be manufactured independently or be formed by performing slitting process step before and after stretching the thin film, wherein the width of the strip is less than the that of the thin film, and the thickness is equivalent to that of the thin film or greater than the that of the thin film.

The ultra-high molecular weight polyethylene thin film or strip provided by the invention is different from the ultra-high molecular weight polyethylene fibers and also different from a plane formed by bonding the multiple ultra-high molecular weight polyethylene fibers, and the significant difference lies in that: the ultra-high molecular weight polyethylene thin film or strip provided by the invention has a certain width and thickness and is an integral structure without integration points or trim lines.

The single yarn provided in each embodiment of the invention is manufactured on the basis of the ultra-high molecular weight polyethylene thin film or strip. In the manufacturing process of the single yarn, the ultra-high molecular weight polyethylene thin film or strip is taken as a whole for treatment, thereby having good structural integrity, being simple in manufacturing process, eliminating a complex process for respectively finishing multiple fiber silks, obviously reducing the probability of producing burrs on the surface of the thin film or strip and also obviously reducing the probability of producing breaking, distortion, intertwining and other phenomena in the thin film or strip. When the single yarn manufactured by converging the ultra-high molecular weight polyethylene thin film or strip bears a load, the ultra-high molecular weight polyethylene thin film or strip is stressed as a whole, so that the strength of the single yarn is relatively high and the strength utilization ratio is effectively improved. Thus, the strength of the single yarn adopting the ultra-high molecular weight polyethylene thin film or strip is higher than that of the product manufactured by adopting the ultra-high molecular weight polyethylene fiber with the same denier number, and the cost of the former is obviously lower than that of the latter.

The single yarn provided in each embodiment of the invention has the advantages of good structural integrity, high strength, high strength utilization ratio, high production efficiency, low processing cost, light weight, small surface density, good flexibility and the like, and can completely replace the traditional ultra-high molecular weight polyethylene fiber to manufacture the products to be widely applied in various fields. Specifically, in each embodiment of the invention, the single yarn can replace the ultra-high molecular weight polyethylene fiber to manufacture the various high-strength fabrics. In the manufacturing process of the high-strength fabric, the single yarns are taken as the basis for processing treatment of a fabric body. Compared with the traditional fabric obtained by processing treatment on the basis of the ultra-high molecular weight polyethylene fibers, the fabric manufactured in each embodiment of the invention has good structural integrity, simple manufacturing process, high production efficiency, high strength, high strength utilization ratio, light weight and good flexibility. When the fabric bears a load, each single yarn is stressed as a whole, so that the strength of the fabric is relatively high and the strength utilization ratio is effectively improved. Thus, the strength of the single yarn product manufactured from the single yarns is much higher than that of the product manufactured on the basis of the ultra-high molecular weight polyethylene fibers with the same denier number, and the cost of the former is obviously lower than that of the latter.

In each embodiment of the invention, the high-strength fabric can comprise the fabric body and can also comprise a protection layer, a reinforcer and other parts; the fabric body can be manufactured by adopting the method provided in each embodiment, and the manufacturing method of other parts in addition to the fabric body can be implemented by adopting related prior art and is not limited in each embodiment of the invention; and in addition, the single yarns can be pre-manufactured before the manufacturing of the fabric body, or the single yarns can be manufactured in the manufacturing process of the fabric body, and the manufacturing is not limited in each embodiment of the invention.

The technical schemes of the invention are further described below by taking several optional structures of the high-strength fabric and the manufacturing method therefor as examples.

Embodiment 1

This embodiment provides a high-strength fabric, which comprises at least a fabric body, the fabric body is formed by interweaving at least one group of single yarns into a whole according to a certain law, and each single yarn is manufactured by converging or converging and twisting an ultra-high molecular weight polyethylene thin film or strip.

A manufacturing method of the high-strength fabric comprises: interweaving at least one group of single yarns into a whole according to a certain law to obtain the fabric body of the high-strength fabric. Optionally, the manufacturing method of the single yarn comprises: converging or converging and twisting the ultra-high molecular weight polyethylene thin film or strip to obtain the single yarn.

Figure 2:
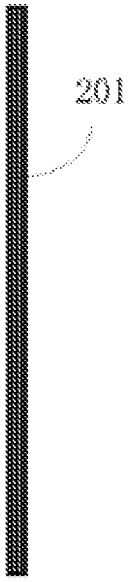
FIG. 2 is a schematic diagram of an optional structure of a single yarn after converging of the thin film or strip provided by an embodiment of the invention.

In this embodiment, the single yarn 201 (as shown in FIG. 2) obtained by converging or converging and twisting the ultra-high molecular weight polyethylene thin film or strip is used for replacing an ultra-high molecular weight polyethylene fiber, the high-strength fabric is manufactured by adopting an interweaving process, the manufacturing process is simple, the production efficiency is high, the manufactured fabric has the advantages of good structural integrity, high strength, high strength utilization ratio, light weight, good flexibility and the like, and can be widely applied to various fields, such as civil use, individual protection, national defense and military supplies, civil engineering, industrial construction, offshore operations, fishing, ship manufacturing, sports goods and the like.

Optionally, in the manufacturing process of the fabric body of the high-strength fabric, at least one group of single yarns can be subject to two-dimensional interweaving or three-dimensional interweaving according to a certain law to form a whole, and the interweaving process can include, but not limited to weaving, knitting or plaiting.

Example 1

Single yarns manufactured by converging or converging and twisting ultra-high molecular weight polyethylene thin films or strips can be used for replacing traditional ultra-high molecular weight polyethylene fibers as raw materials, and a high-strength fabric is manufactured on the basis of a weaving process.

The multiple groups of single yarns can be divided into at least one group of warp yarns and at least one group of weft yarns, and the warp yarns and the weft yarns are perpendicular to each other and are crosswise woven into a two-dimensional woven fabric on a weaving machine according to a certain law. The optional process flow is as follows: preparing the single yarns, warping, opening, feeding the warp yarns, performing weft insertion, performing weft knitting, reeling and preparing the woven fabric. The product form of the high-strength fabric manufactured by the scheme is not limited, for example, the product forms can include, but not limited to high-strength structural members, high-strength suitcases, bulletproof vests, bulletproof plates, geogrids, bulletproof and explosion-proof suitcases and other products, and can better meet the special requirements of these products on strength, weight and other performance of the fabrics.

Example 2

Single yarns manufactured by converging or converging and twisting ultra-high molecular weight polyethylene thin films or strips can be used for replacing traditional ultra-high molecular weight polyethylene fibers as raw materials, and a high-strength fabric is manufactured on the basis of a knitting process.

Figure 3:
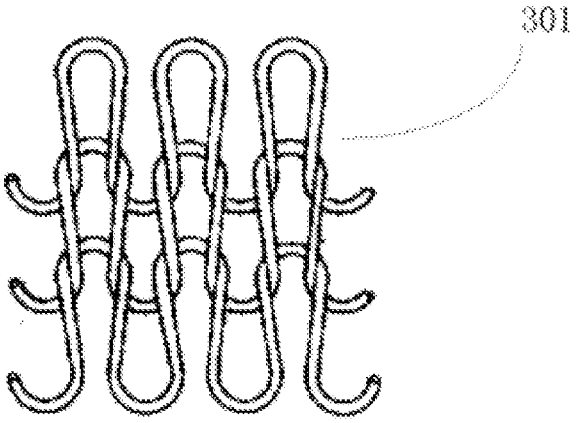
FIG. 3 is a schematic diagram of an optional structure of a two-dimensional knitted fabric provided by an embodiment of the invention.

As shown in FIG. 3, one group or multiple groups of single yarns can be mutually stringed, looped and connected according to a certain law on a knitting machine to manufacture a two-dimensional knitted fabric 301. The optional process flow is as follows: preparing the single yarns, feeding the yarns, weaving, performing transmission, drawing and reeling and preparing the knitted fabric. The product form of the high-strength fabric manufactured by the scheme is not limited, for example, the product forms can include, but not limited to high-strength structural members, anti-cutting gloves and other products, and can better meet the special requirements of these products on strength, shape, weight and other performance of the fabrics.

Example 3

Single yarns manufactured by converging or converging and twisting ultra-high molecular weight polyethylene thin films or strips can be used for replacing traditional ultra-high molecular weight polyethylene fibers as raw materials, and a high-strength fabric is manufactured on the basis of a three-dimensional weaving process.

Figure 4:
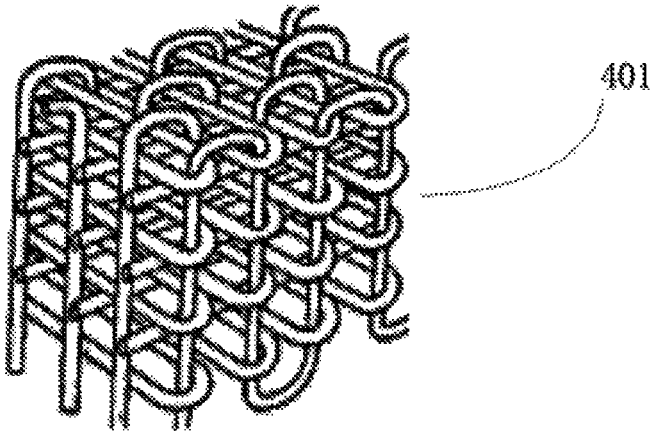
FIG. 4 is a schematic diagram of an optional structure of a three-dimensional woven fabric provided by an embodiment of the invention.

As shown in FIG. 4, the multiple groups of single yarns can be divided into at least one group of warp yarns and at least one group of weft yarns, the single yarns introduced in the thickness direction interweave the warp yarns and the weft yarns which are perpendicular to each other layer by layer into a whole to obtain a fabric 401 with a three-dimensional woven structure, and the fabric can be integrally formed by a weaving machine. The optional process flow is as follows: preparing the single yarns, penetrating the warp yarns, opening, performing weft insertion, interweaving, performing weft knitting, reeling and preparing a fabric body with the three-dimensional woven structure. The product form of the high-strength fabric manufactured by the scheme is not limited, for example, the product forms can include, but not limited to reinforcing structural members, bulletproof plates, impact-resistant plates and other products, and can better meet the special requirements of these products on strength, shape, weight and other performance of the fabrics.

Example 4

Single yarns manufactured by converging or converging and twisting ultra-high molecular weight polyethylene thin films or strips can be used for replacing traditional ultra-high molecular weight polyethylene fibers as raw materials, and a high-strength fabric is manufactured on the basis of a three-dimensional plaiting process.

A three-dimensional plaiting machine can be utilized to weave at least one group of single yarns to form the fabric with a three-dimensional woven structure. The optional process flow is as follows: preparing the single yarns, weaving and preparing the fabric with the three-dimensional woven structure.

The product form of the high-strength fabric manufactured by the scheme is not limited, for example, the product forms can include, but not limited to reinforcing structural members, bulletproof plates, impact-resistant plates and other products, and can better meet the special requirements of these products on strength, shape, weight and other performance of the fabrics.

Example 5

Single yarns manufactured by converging or converging and twisting ultra-high molecular weight polyethylene thin films or strips can be used for replacing traditional ultra-high molecular weight polyethylene fibers as raw materials, and a high-strength fabric is manufactured on the basis of a net plaiting process.

Figure 5:
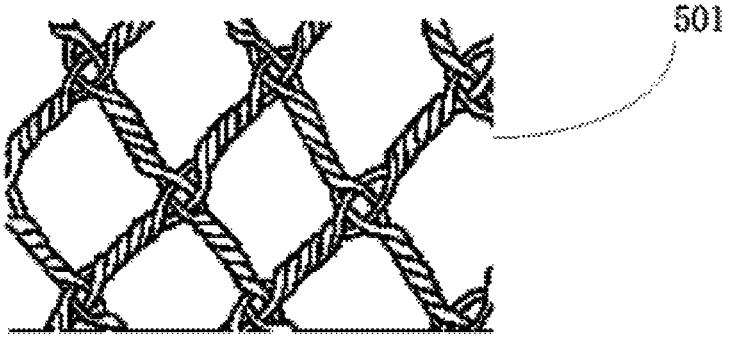
FIG. 5 is a schematic diagram of an optional structure of a net fabric provided by an embodiment of the invention.

As shown in FIG. 5, at least one group of single yarns or a single-yarn product obtained after twisting or plaiting the single yarns is subject to intersection, interweaving, knotting or non-knotting plaiting according to a certain law to obtain a two-dimensional fabric 501 or a three-dimensional fabric with meshes. The optional process flow is as follows: preparing the single yarns, twisting, preparing mesh wires and preparing the two-dimensional fabric or the three-dimensional fabric with the meshes. The product form of the high-strength fabric manufactured by the scheme is not limited, for example, the product forms can include, but not limited to net pieces, deep water net cages, ocean-going drag nets and other products, and can better meet the special requirements of these products on strength, weight and other performance of the fabrics.

According to each scheme in this embodiment, the single yarns manufactured by converging or converging and twisting the ultra-high molecular weight polyethylene thin films or strips are used for replacing the traditional ultra-high molecular weight fibers as the raw materials, weaving, knitting, plaiting and other interweaving processes are adopted to manufacture the various fabrics with two-dimensional planar structures or three-dimensional structures, the manufactured fabrics have one or more advantages of good structural integrity, high strength, high strength utilization ratio, light weight, good flexibility and the like, and the fabrics can be used for replacing the various fabrics manufactured on the basis of the ultra-high molecular weight polyethylene fibers, and a broad range of application is further realized.

Embodiment 2

This embodiment provides a high-strength fabric, which comprises at least a fabric body, the fabric body is formed by performing non-interweaving type connection on at least one group of single yarns according to a certain law to form a whole, and each single yarn is manufactured by converging or converging and twisting an ultra-high molecular weight polyethylene thin film or strip.

A manufacturing method of the high-strength fabric comprises: performing non-interweaving type connection on at least one group of single yarns according to a certain law to form a whole, thereby obtaining the fabric body of the high-strength fabric. Optionally, the manufacturing method of the single yarn comprises: converging or converging and twisting the ultra-high molecular weight polyethylene thin film or strip to obtain the single yarn.

In this embodiment, the single yarn obtained by converging or converging and twisting the ultra-high molecular weight polyethylene thin film or strip is used for replacing an ultra-high molecular weight polyethylene fiber, the high-strength fabric is manufactured by adopting a non-interweaving non-weaving process, the manufacturing process is simple, the production efficiency is high, the manufactured fabric has the advantages of good structural integrity, high strength, high strength utilization ratio, light weight, good flexibility and the like, and can be widely applied to various fields, such as civil use, individual protection, national defense and military supplies, civil engineering, industrial construction, offshore operations, fishing, ship manufacturing, sports goods and the like.

Optionally, in the manufacturing process of the fabric body of the high-strength fabric, at least one group of single yarns can be subject to non-interweaving type connection according to a certain law on the basis of the non-weaving process to form a whole, and the interweaving type connection can include, but not limited to: binding connection, bonding or hot-pressing connection. The manufactured high-strength fabric can include one or more single-layer structures. The multiple single yarns can be sequentially arranged and subject to non-interweaving type connection along a direction to form a whole, thereby preparing a single-layer structure. If the high-strength fabric has multiple single-layer structures, the multiple single-layer structures can be crosswise compounded and laminated into a whole at certain angles to manufacture the high-strength fabric.

Example 6

Single yarns manufactured by converging or converging and twisting ultra-high molecular weight polyethylene thin films or strips can be used for replacing traditional ultra-high molecular weight polyethylene fibers as raw materials, and a high-strength fabric with a single-layer structure, such as unidirectional fabric is manufactured on the basis of a non-weaving process.

The multiple single yarns can be sequentially arranged along a direction and further bound and connected into a whole through binding yarns; synthetic fibers, high-strength fibers and other yarns can be selected as the binding yarns, and the binding yarns are arranged at intervals perpendicularly to the length direction of the single yarns. Compared with the single yarns, the fiber number of the binding yarns can be relatively small, the single yarns are bound and connected into a whole under the action of the binding yarns, and the obtained high-strength fabric is called as the unidirectional fabric. One optional process flow of the unidirectional fabric is as follows: preparing the single yarns, warping, preparing the binding yarns, weaving, reeling and preparing the unidirectional fabric. The unidirectional fabric manufactured by the scheme can be used for preparing various products, which include, but not limited to non-woven fabrics, reinforcing structural members, high-strength suitcases, bulletproof plates, impact-resistant plates, bulletproof and explosion-proof suitcases and the like, and can better meet the special requirements of these products on strength, weight, bulletproof performance and other performance of the fabrics.

Figure 6:
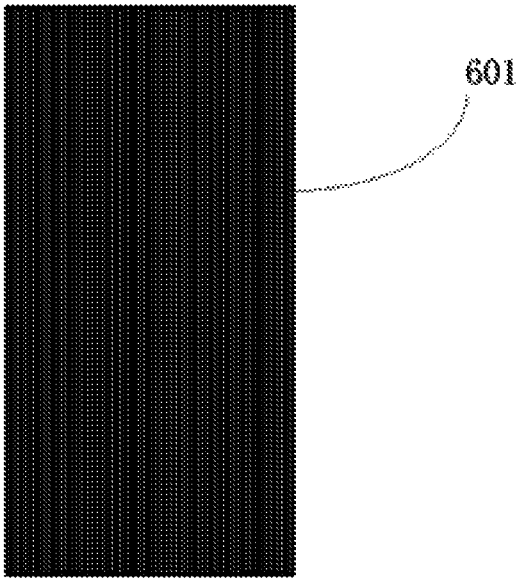
FIG. 6 is a schematic diagram of an optional structure of a unidirectional fabric provided by an embodiment of the invention.

Of course, in the manufacturing process of the high-strength fabric with the single-layer structure, such as the unidirectional fabric and the like, the various single yarns can also adopt other connection ways in addition to the binding yarns, for example, the various single yarns which are unidirectionally arranged are impregnated or glued as a whole to bond the various single yarns into a whole to obtain the unidirectional fabric 601 (as shown in FIG. 6); or the various single yarns which are unidirectionally arranged are subject to hot-pressing treatment at the temperature which is lower than a melting point of the ultra-high molecular weight polyethylene thin film or strip and a certain pressure to connect the various single yarns into a whole, etc.

Example 7

Single yarns manufactured by converging or converging and twisting ultra-high molecular weight polyethylene thin films or strips can be used for replacing traditional ultra-high molecular weight polyethylene fibers as raw materials, single-layer structures, such as unidirectional fabrics and the like are manufactured on the basis of a non-weaving process, and the various single-layer structures are crosswise compounded and laminated into a whole at certain angles to manufacture a high-strength fabric, such as a non-woven fabric and the like.

Figure 7:
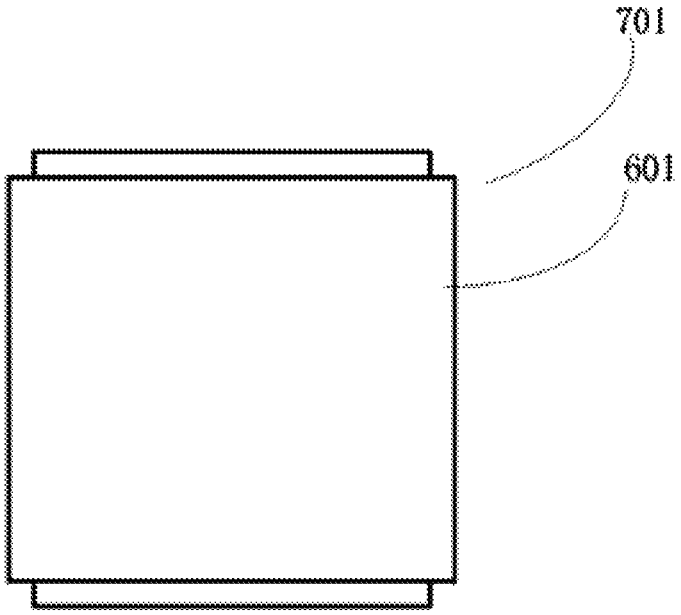
FIG. 7 is a schematic diagram of an optional structure of a non-woven fabric with an intersection angle of 90 degrees provided by an embodiment of the invention.

Wherein, the intersection angles of any two adjacent single-layer structures can be the same, the intersection angle can be any angle of 0-90 degrees, for example, the intersection angle is 45 degrees; or the intersection angle is 90 degrees, and if the multiple layers of unidirectional fabrics 601 are sequentially crosswise laminated at 0/90 degrees (as shown in FIG. 7), and the various layers of unidirectional fabrics are bonded or subject to hot-pressing connection to manufacture the non-woven fabric 701. The non-woven fabric manufactured by the scheme has high strength, when the non-woven fabric is subject to shooting of a bullet and other external strong impact force, a force-bearing point can be diffused to a force-bearing surface, energy is rapidly diffused, and the bulletproof performance is good.

Figure 8:
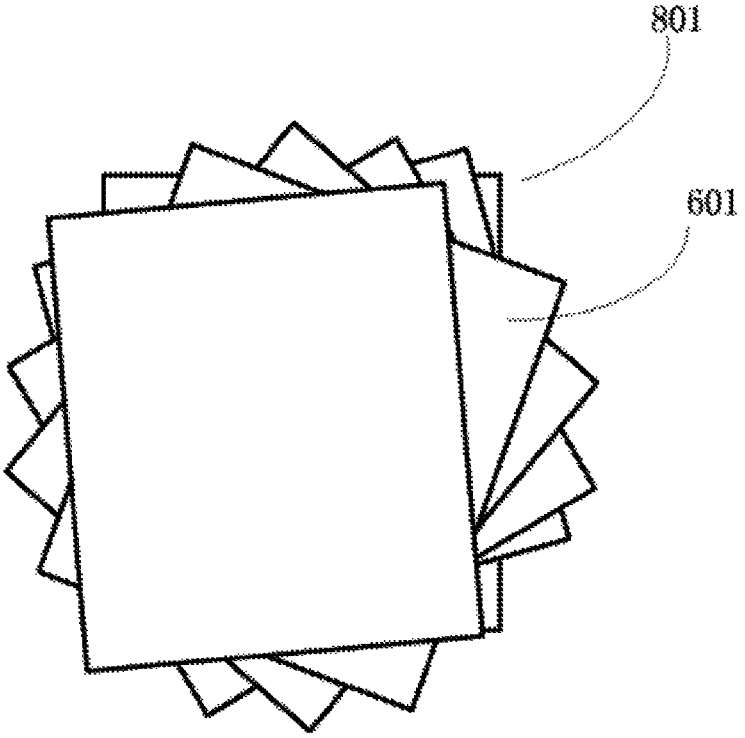
FIG. 8 is a schematic diagram of an optional structure of a non-woven fabric with gradually increased intersection angles provided by an embodiment of the invention.

Or, the intersection angles of at least two single-layer structures in the various single-layer structures are different from the intersection angles of other single-layer structures, for example, the intersection angles of every two adjacent single-layer structures from the first single-layer structure to the last single-layer structure are gradually increased, then the single-layer structures with the different intersection angles are laminated into a whole to manufacture the non-woven fabric 801 (as shown in FIG. 8) which can better improve the strength, the bulletproof performance and other performance of the fabric.

The non-woven fabric manufactured by the scheme can be used for preparing various products, which include, but not limited to reinforcing structural members, high-strength suitcases, bulletproof plates, impact-resistant plates, bulletproof helmets, bulletproof and explosion-proof suitcases and the like, and can better meet the special requirements of these products on strength, weight, bulletproof performance and other performance of the fabrics.

According to each scheme in this embodiment, the single yarns manufactured on the basis of converging or converging and twisting the ultra-high molecular weight polyethylene thin films or strips are used for replacing the traditional ultra-high molecular weight fibers as the raw materials, the multiple single yarns are unidirectionally arranged and are integrally connected by adopting binding connection, bonding, hot-pressing connection and other non-interweaving type connection ways to manufacture high-strength fabrics, such as unidirectional fabrics, non-woven fabrics and the like, the warping process of the single yarns is simpler than the warping process of traditional ultra-high molecular weight fibers, the amount of glue can be reduced, and the glue can even be avoided, thereby reducing environmental pollution; and furthermore, the manufactured fabrics have one or more advantages of good structural integrity, high strength, high strength utilization ratio, light weight, good bulletproof performance and the like, and can replace the various fabrics manufactured on the basis of the ultra-high molecular weight polyethylene fibers, and a broad range of application is further realized.

Further, optionally, in each embodiment of the invention, the related parameters of the ultra-high molecular weight polyethylene thin film at least meet one or more of the following conditions: the linear density is above 5000 deniers; the width is above 100 mm; the thickness is below 0.2 mm; the breaking strength is above 10 grams/denier; the tensile modulus is above 800 grams/denier; and the elongation at break is below 6%. By preparing the fabric on the basis of the ultra-high molecular weight polyethylene thin film with one or more properties, the fabric has higher integral strength and can meet the manufacturing requirements of high-strength load, bulletproof and other fabric products.

Optionally, in each embodiment of the invention, the related parameters of the ultra-high molecular weight polyethylene thin film at least meet one or more of the following conditions: the linear density is above 100 deniers; the width is 1-100 mm; the thickness is below 0.2 mm; the breaking strength is above 10 grams/denier; the tensile modulus is above 800 grams/denier; and the elongation at break is below 6%. By preparing the fabric on the basis of the ultra-high molecular weight polyethylene strip with one or more properties, the fabric has higher integral strength and can meet the manufacturing requirements of high-strength load, bulletproof and other fabric products.

In the various embodiments of the invention, the serial numbers and/or the sequences of the embodiments are only used for description and do not represent the superiority of the embodiments. The description of the embodiments places the emphasis on different parts, and the part which is not described in detail in a certain embodiment can refer to the related description in other embodiments.

In the embodiments of the device, the method and the like of the invention, it is obvious that all the parts or the all the steps can be decomposed, combined and/or re-combined after decomposition. These decompositions and/or re-combinations should be considered as equivalent schemes of the invention. At the same time, in the above description of the specific embodiments of the invention, the characteristics described and/or illustrated against one implementation can be used in one or more other implementations in the same or similar manner, and can be combined with the characteristics in other implementations or be used for substituting the characteristics in other implementations.

It should be emphasized that, the term "including/comprising" refers to the existence of the characteristics, elements, steps or components when being used herein, but does not exclude the existence or addition of one or more other characteristics, elements, steps or components.

Finally, it should be noted that, although the invention and the advantages thereof have been described in detail, it should be understood that various modifications, substitutions and changes can be made without exceeding the spirit and the scope of the invention defined by the appended claims. Furthermore, the scope of the invention is not limited to the specific embodiments of processes, equipment, means, methods and steps described in the description. According to the disclosure of the invention, those of ordinary skill in the art can easily understand that the processes, the equipment, the means, the methods or the steps which are existing, will be developed in the future and execute the basically same functions with the corresponding embodiments or obtain the basically same results can be used. Thus, the appended claims aim at including such processes, equipment, means, methods or steps within the scope.

The invention claimed is:

1. A fabric, characterized in that the fabric includes a fabric body which is formed by connecting at least one group of single yarns according to a certain pattern, wherein each single yarn is prepared by converging or converging and twisting a plurality of ultra-high molecular weight polyethylene films or strips into a whole, and the ultra-high molecular weight polyethylene film or strip has a certain width and thickness and has an integral structure without integration points or trim lines; and wherein the ultra-high molecular weight polyethylene films or strips meet at least one or more of the following conditions:

a breaking strength is above 10 grams/denier;

a tensile modulus is above 800 grams/denier; and an elongation at break is below 6%.

2. The fabric according to claim 1, wherein the ultra-high molecular weight polyethylene film meet at least one or more of the following conditions:

a linear density is above 5000 deniers;

a width is above 100 mm; and a thickness is below 0.2 mm.

3. The fabric according to claim 1, wherein the ultra-high molecular weight polyethylene strip meet at least meet one or more of the following conditions:

a linear density is above 100 deniers;

a width is 1-100 mm; and a thickness is below 0.2 mm.

4. The fabric according to claim 1, wherein the fabric body is formed by two-dimensional interweaving or three-dimensional interweaving a plurality of single yarns to form a whole.

5. The fabric according to claim 4, wherein interweaving comprises: weaving, knitting or machine weaving.

6. The fabric according to claim 1, wherein the fabric body comprises at least one single-layer structure, and each single-layer structure is formed by sequentially performing arrangement along a direction and non-interweaving type connection of multiple single yarns to form a whole.

7. The fabric according to claim 6, wherein the non-interweaving type connection comprises: binding connection, bonding or hot-pressing connection.

8. The fabric according to claim 6, wherein the fabric body is formed by overlapping at certain angles multiple single-layer structures and laminating them to form a whole.

9. The fabric according to claim 8, wherein a plurality of intersection angles of any two adjacent single-layer structures are the same.

10. The fabric according to claim 9, wherein any one of a plurality of intersection angles is 0-90 degrees.

11. The fabric according to claim 10, wherein any one of a plurality of intersection angles is 45 degrees or 90 degrees.

12. The fabric according to claim 8, wherein an intersection angle between at least two adjacent single-layer structures in any one of a plurality of various single-layer structures is different from any one of a plurality of intersection angles of other single-layer structures.

13. The fabric according to claim 12, wherein the intersection angles of any two adjacent single-layer structures are gradually increased from the first single-layer structure to a last single-layer structure.

* * * * *